United States Patent [19]

Hodas

[11] 3,984,023

[45] Oct. 5, 1976

[54] UNDERGROUND VALVE BOX

[75] Inventor: Ernest Hodas, Lathrup Village, Mich.

[73] Assignee: Whole Earth Holding Company, Lathrup Village, Mich.

[22] Filed: Oct. 28, 1975

[21] Appl. No.: 626,149

[52] U.S. Cl. ..... 220/4 F; 220/18; 220/22

[51] Int. Cl.[2] ..... B65D 7/00; B65D 25/24

[58] Field of Search ..... 220/4 R, 4 F, 18, 76, 220/22, 22.1, 22.2

[56] References Cited

UNITED STATES PATENTS

| | | | |
|---|---|---|---|
| 3,069,002 | 12/1962 | Hart | 220/4 F X |
| 3,263,853 | 8/1966 | Smith | 220/18 |
| 3,759,412 | 9/1973 | Bush | 220/4 F X |
| 3,913,774 | 10/1975 | Vaitay | 220/4 R |
| 3,920,144 | 11/1975 | Callen | 220/22 |

*Primary Examiner*—William Price
*Assistant Examiner*—Steven M. Pollard
*Attorney, Agent, or Firm*—Reising, Ethington, Barnard, Perry and Brooks

[57] ABSTRACT

A rectangular underground valve box is made from separate side and end walls of plastic that may be packaged for shipping and storage in a compact manner. The walls include interlocking portions adjacent their edges that secure them to each other during assembly of the box. The bottom side of the box is open to permit positioning of the box over one or more underground valves. A plastic cover is pivoted to the box so as to control access to the valve or valves within the box. The box may be divided into one or more compartments that each receive an associated valve.

9 Claims, 6 Drawing Figures

UNDERGROUND VALVE BOX

BACKGROUND OF THE INVENTION

1. Field of the Invention

This invention relates generally to underground valve boxes for enclosing underground valves such as lawn and garden sprinkling system valves, other irrigation system valves, and other underground valves used for different purposes.

2. Description of the Prior Art

Underground valve boxes of the type to which this invention relates have bottom sides that are open so they can be positioned over underground valves. The top side of such a valve box is usually flush or slightly above or below the ground level and includes a cover controlling access to the valve.

Valve boxes of the type described above have been made from steel in the past and, more recently, from plastic which does not have any corrosion problem. Side and end walls of the steel type of boxes have heretofore been formed into their box-like shape prior to shipment from the manufacturer's factory. Likewise, the plastic type of box has heretofore had side and end walls that are formed integrally with each other, usually by a molding process. The prior art steel and plastic underground valve boxes thus require considerable volume for shipping and storage. The plastic type of box has been made in a manner so they can be stacked within each other to reduce the required volume for shipping and storage. However, shipment of a single box of even the stacked type still requires a package that is relatively large.

SUMMARY OF THE INVENTION

An object of the present invention is to provide an underground valve box that may be shipped and stored in a compact manner and then conveniently assembled for use.

In carrying out the above object, as well as other objects, the underground valve box includes rectangular side and end walls of plastic that are separate from each other so they can be packaged for shipping and storage in a compact fashion. The walls include interlocking portions adjacent their edges that are interengaged in a locking relationship to secure the walls to each other. The bottom side of the assembled box opens downwardly to permit positioning of the box over an underground valve. A plastic cover is pivoted to the box so as to control access to the valve received within its interior.

The interlocking portions of the box walls are preferably embodied as projections on certain of the walls and openings on the other walls. During assembly, the projections are received within the openings in the locking relationship that secures the walls to each other. The openings are preferably of an elongated rectangular configuration and the projections have tabs and ramp surfaces extending in alignment with the elongated direction of the openings. The ramp surfaces cam the tabs into the locking relationship within the openings. The walls having the openings also preferably include spaced lugs for receiving the edges of the walls having the projections. The spaced lugs thus cooperate with the projections and openings in locating the walls with respect to each other.

The plastic cover of the box preferably includes an attachment flange secured to the box and an integral hinge pivotally supporting the rest of the cover on the flange. The attachment flange includes attachment portions that are snapped onto one wall of the box. These attachment portions project downwardly and have lower ends that are received within openings in the wall to which the cover is secured.

The valve box may be constructed with a single compartment that is sized to receive a single valve. Likewise, the box may have a larger size so as to receive more than one valve. The interior of the box may be divided into separate compartments associated with each valve. Also, the side walls and cover of a dual valve box may be divided so as to construct separate single valve boxes.

The objects, features and advantages of the present invention are readily apparent from the following detailed description of the preferred embodiment taken in connection with the accompanying drawings.

DETAILED DESCRIPTION OF THE PREFERRED EMBODIMENT

Figure 1:
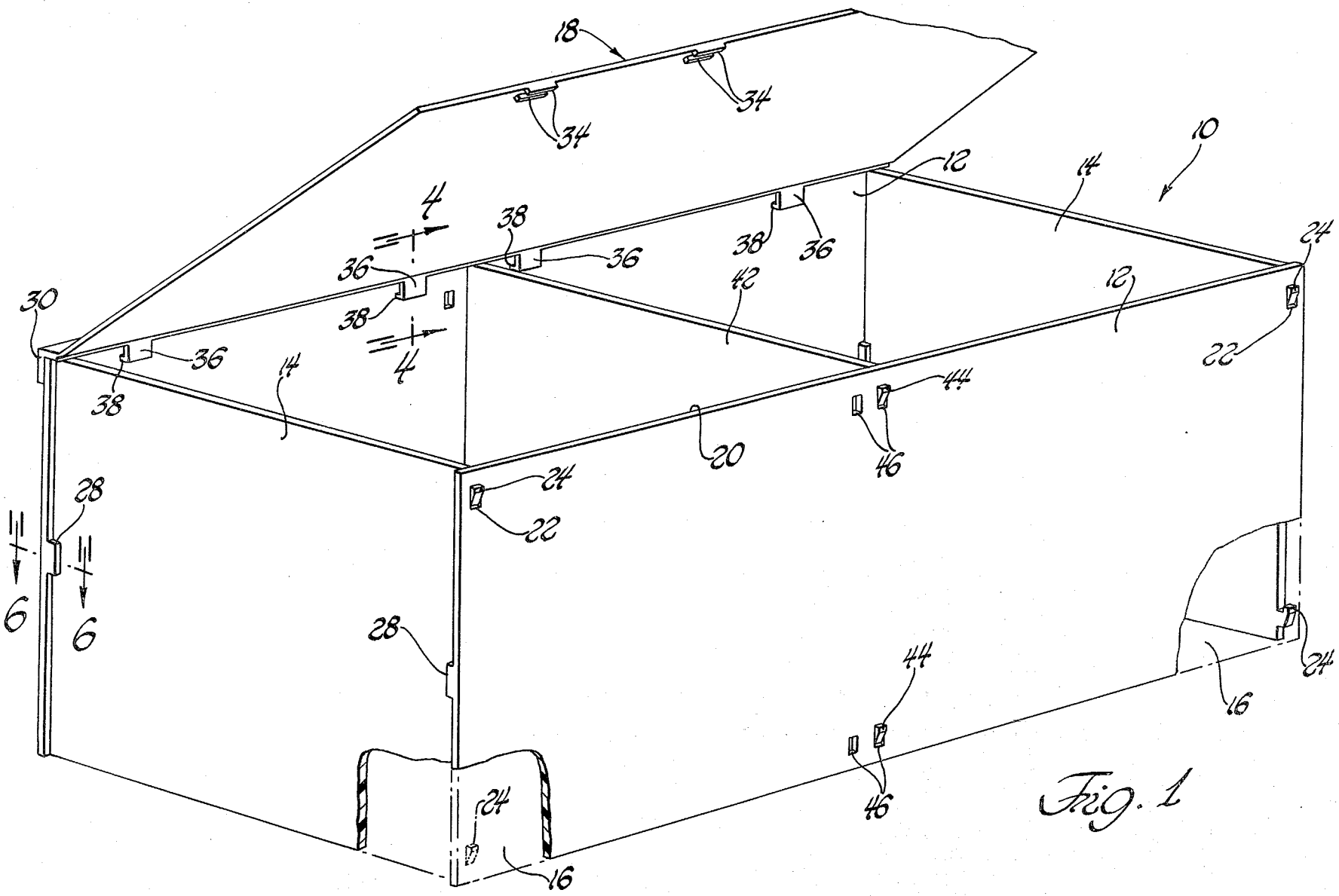
FIG. 1 is a perspective view of an underground valve box embodying the present invention.

Referring to FIG. 1 of the drawings, an underground valve box embodying the present invention is indicated generally by reference numeral 10. The valve box includes rectangular side walls 12 and rectangular end walls 14 that have planar configurations and are composed of a suitable plastic, such as polyethylene, so there is no tendency for the box to corrode. These side and end walls of the valve box are made separately from each other, preferably by molding, so they can be packaged for shipping and storage in a compact manner. The edges of the valve box walls are secured to each other to assemble the box for use. The bottom side 16 of the assembled box is open to permit positioning of the box over one or more underground valves. A plastic cover 18 is pivoted to the box so as to selectively open and close its top side 20. The open cover 18 allows manual access for valve actuation, while the closed cover provides shielding of the valve or valves within the box.

Figure 2:
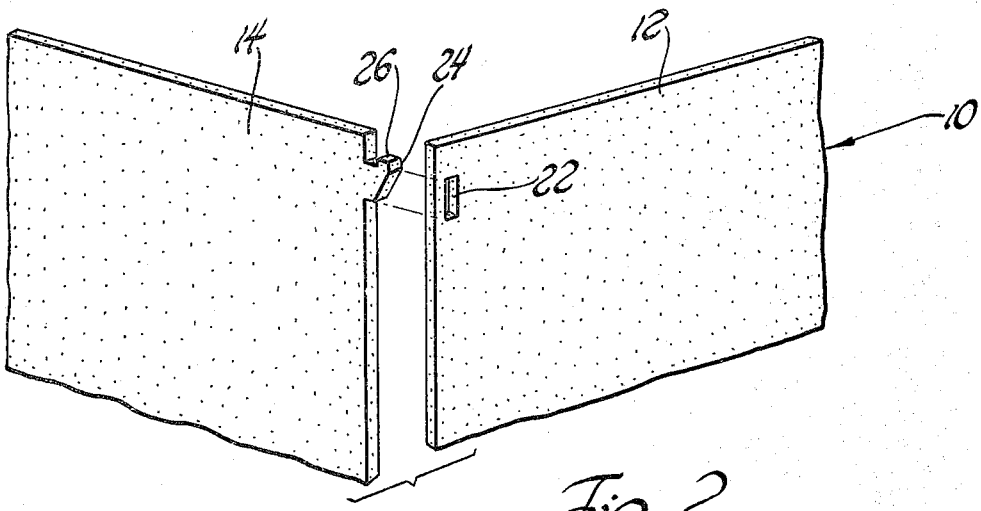
FIG. 2 is an exploded perspective view illustrating the manner of securing walls of the box to each other.

With additional reference to FIG. 2, the side walls 12 of the box define rectangular openings 22 that are elongated in a vertically extending direction. The end walls 14 of the box include projections 24 that are received within associated openings 22 during the assembly of the box walls. The openings 22 and projections 24 of the side and end walls are located adjacent the edges of these walls at their upper and lower extremities. These openings and projections provide interlocking portions for securing the walls to each other. The projections have tabs 26 that extend in alignment with the vertically elongated direction of the openings 22 and give the projections a greater total height than the openings. The projections also include ramp surfaces 27 aligned with the vertically elongated direction of the openings. These ramp surfaces engage the side walls within the openings 22 during the assembly and cam the projections 24 into a locking relationship within the openings. The tabs 26 of the projections extend through the openings and grip the opposite side of the wall above the upper ends of the openings in their locking relationship.

Figure 5:
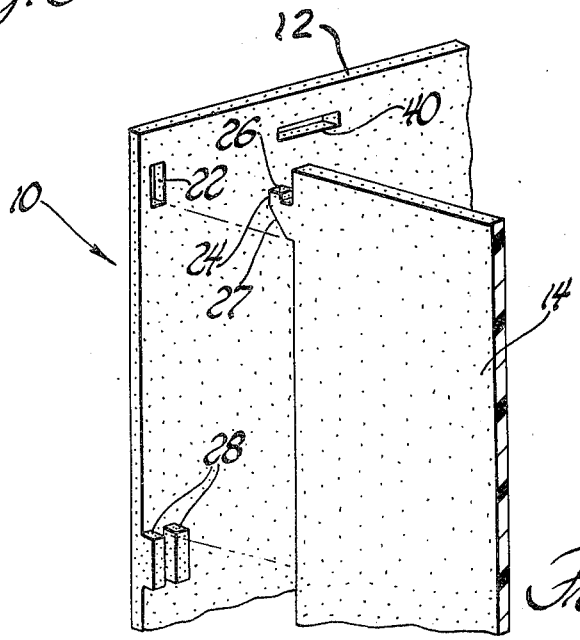
FIG. 5 is an exploded perspective view illustrating the securement of the box walls to each other.
Figure 6:
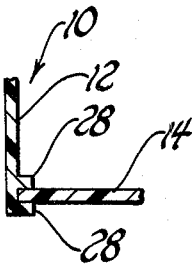
FIG. 6 is a sectional view of the box taken along line 6—6 of FIG. 1.

As seen by combined reference to FIGS. 1, 5 and 6, intermediate the vertically spaced openings 22, the side walls 12 of the box include spaced lugs 28 that receive the adjacent edges of the associated end wall 14 during assembly of the box. The spaced lugs 28 thus cooperate with the openings 22 and projections 24 in providing positioning of the walls with respect to each other. The lugs 28 preferably receive the wall edges in an interference fit manner that rigidifies the wall interconnection.

Figure 3:
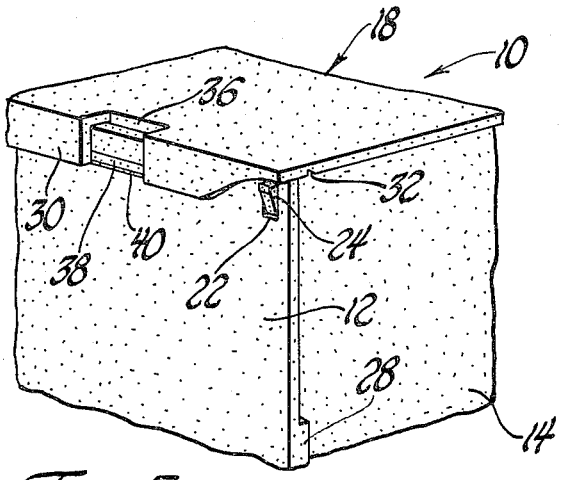
FIG. 3 is a perspective view of the box showing the cover used to close its upper side.
Figure 4:
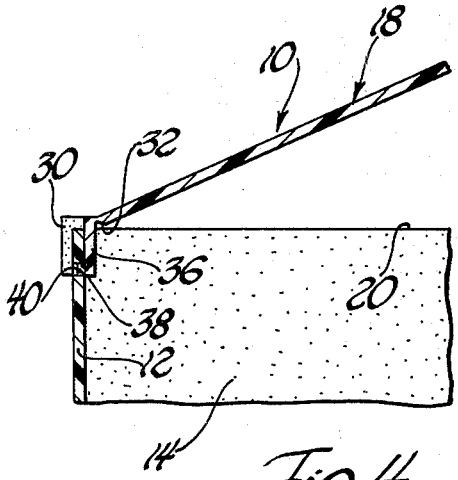
FIG. 4 is a sectional view of the box taken along line 4—4 of FIG. 1 and illustrates the manner of securing the cover to the box.

As seen by combined reference to FIGS. 1, 3 and 4, the cover 18 of the valve box includes an elongaged attachment flange 30 that has a L-shaped cross-section. The attachment flange 30 is secured to the upper edge of one of the side walls 12 to support the cover on the box. An elongated groove 32 on the lower side of the cover runs alongside the attachment flange 30 and provides an integral hinge for supporting the rest of the cover for the pivotal movement between its open and closed positions. Preferably, the cover includes spaced lugs 34, FIG. 1, on its swinging edge which are engaged in an interference fit manner with the upper edge of the other side wall 12 in the closed position. This engagement locates the cover 18 in its closed position but selectively permits opening of the cover for manual access within the valve box.

A plurality of attachment portions or legs 36 project downwardly in a spaced relationship to the attachment flange 30 so as to receive the upper side wall edge to which the cover is secured. The legs 36 have lower ends 38, FIG. 4, that extend toward the attachment flange 30 and are received within openings 40, FIG. 5, in the side wall 12 supporting the cover. The lower ends 38 of the attachment legs snap into the openings 40 so as to cooperate with the attachment flange 30 in securing the cover in position. The cover 18, like the side and end walls 14, is thus readily assembled without the necessity of any tools, adhesives, etc.

With reference to FIG. 1, the interior of the box shown is divided into a pair of compartments by an intermediate wall 42. This wall is secured to the side walls by interengaged projections 44 and openings 46 in the same manner the ends of the side walls 12 are secured to the end walls 14 by the openings 22 and projections 24. It should be noted that there are a pair of the openings 46 provided so that the side walls 12 and cover 18 can be divided, such as by cutting with a saw or otherwise, to provide separate boxes. The intermediate wall 42 would then function as an end wall for the right-hand box while an additional end wall would be required for the left-hand box. In this regard, it should be noted that each half of the cover 18 has a pair of the projections 36 that cooperate with the attachment flange 30 in securing the cover in place. Consequently, the cover will be securely positioned even if such a division of the box is required.

It is not absolutely necessary to divide the box 10 into individual compartments for each valve received within the box. Two or more valves can readily be received within the same compartment of the box. However, the use of an intermediate wall dividing the box into separate compartments is helpful in providing support between the side walls 12. This support is especially advantageous when the box has an extremely elongated configuration.

While a preferred embodiment has been described, those skilled in the art will recognize various alternative embodiments and structures embodying the present invention as described by the following claims.

What is claimed is:

1. A generally rectangular underground valve box comprising: rectangular side and end walls of plastic that have generally planar configurations; said walls being separate from each other so as to be capable of being packaged for shipping and storage in a compact manner; said walls including interlocking portions adjacent edges thereof that are interengaged in a locking relationship to secure the walls to each other; the bottom side of the assembled box being open to permit positioning thereof over an underground valve; one of said plastic walls including an upper edge having attachment portions; a plastic cover for selectively opening and closing the top side of the box so as to thereby control access to a valve received within the box; said cover having a rectangular shape and including an edge having an attachment flange and an integral hinge pivotally connecting the attachment flange to the rest of the cover; the attachment flange including attachment portions that snap into a locking relationship with the attachment portions on the upper edge of the one wall to mount the cover for pivotal movement between open and closed positions with respect to the top side of the box.

2. A valve box according to claim 1 wherein the interlocking portions include projections on certain of the walls and openings on the other walls which receive the projections in the locking relationship.

3. A valve box according to claim 2 wherein the openings are of an elongated rectangular configuration and the projections have ramp surfaces and tabs extending in alignment with the elongated direction of the openings.

4. A valve box according to claim 2 wherein the walls having the openings also include spaced lugs for receiving the edges of the walls having the projections so as to cooperate with the projections and openings in securing the walls with respect to each other.

5. A valve box according to claim 1 wherein the attachment portions of the one wall include openings in the upper edge thereof and wherein the attachment portions of the attachment flange snap into the openings in the one wall of the box to secure the cover.

6. A valve box according to claim 5 wherein the attachment portions of the attachment flange project downwardly and have lower ends that snap into the openings in the one wall to provide the securement thereto.

7. A valve box according to claim 1 wherein the box includes an intermediate wall dividing the interior thereof into a pair of valve compartments.

8. A valve box according to claim 7 wherein the side walls and cover of the box may be divided to construct separate boxes.

9. A valve according to claim 1 wherein the attachment portions of the one wall include openings in the upper edge thereof, the attachment flange of the cover being positioned on the outer side of the one wall and the attachment portions of the flange being positioned on the inner side of the wall and including lower ends that snap into the openings in the upper edge of the one wall.

* * * * *